US007987890B2

(12) United States Patent
Wilson

(10) Patent No.: US 7,987,890 B2
(45) Date of Patent: Aug. 2, 2011

(54) BLINDS AND COMPONENTS THEREOF

(75) Inventor: Neil Wilson, Glasgow (GB)

(73) Assignee: Turnils (UK) Ltd, Renfrew, Scotland (GB)

( * ) Notice: Subject to any disclaimer, the term of this patent is extended or adjusted under 35 U.S.C. 154(b) by 1219 days.

(21) Appl. No.: 11/669,570

(22) Filed: Jan. 31, 2007

(65) Prior Publication Data

US 2007/0175600 A1 Aug. 2, 2007

(30) Foreign Application Priority Data

Feb. 1, 2006 (GB) ..... 0602015.0

(51) Int. Cl.

| | |
|---|---|
| ***E06B 9/303*** | (2006.01) |
| ***E06B 9/305*** | (2006.01) |
| ***E06B 9/307*** | (2006.01) |
| ***E06B 9/322*** | (2006.01) |

(52) U.S. Cl. ..... 160/176.1 R; 160/177 R

(58) Field of Classification Search ..... 160/107, 160/902, 166.1, 176.1 R, 177 R, 178.1 R, 160/178.3 R, 168.1 R See application file for complete search history.

(56) References Cited

U.S. PATENT DOCUMENTS

| | | | | |
|---|---|---|---|---|
| 5,143,135 | A * | 9/1992 | Kuhar | 160/107 |
| 5,934,351 | A | 8/1999 | Bharucha et al. | |
| 6,622,770 | B1 | 9/2003 | Tyner | |
| 2009/0256036 | A1 | 10/2009 | Wilson | |

FOREIGN PATENT DOCUMENTS

| | | | |
|---|---|---|---|
| DE | 33 13 833 | A1 | 10/1984 |
| DE | 20 2004 009270 | U1 | 8/2004 |
| EP | 0 976 908 | A1 | 2/2000 |
| EP | 1 431 507 | A2 | 6/2004 |
| EP | 1 526 245 | A1 | 4/2005 |
| GB | 1070526 | A | 6/1967 |
| SE | 457 978 | | 2/1989 |
| WO | WO 2008/015442 | A1 | 2/2008 |

* cited by examiner

*Primary Examiner* — Blair M Johnson
*Assistant Examiner* — Jeremy C Ramsey
(74) *Attorney, Agent, or Firm* — Dorsey & Whitney LLP

(57) ABSTRACT

The invention relates to blinds, components of blinds and assembly of blinds, and particularly to the tilt mechanism of a Venetian blind. The tilt mechanism includes a slider element to which the cords of the cord ladder are attached. The slider element has a base portion fixedly mounted in an aperture of the head rail, and a sliding portion. The ladder cords are routed through holes in the base portion, through a void between the sliding portion and the base portion and out of the ends of the slider element. The ends of the ladder cords are secured proximate respective ends of the sliding portion. The void is divided into separate chambers and the holes of the base portion communicate each with a respective chamber. A further hole and chamber may be provided to accommodate a lift cord. Tangling of the cords is eliminated, and the compact arrangement allows a slim and attractive head rail to be used.

27 Claims, 8 Drawing Sheets

BLINDS AND COMPONENTS THEREOF

CROSS-REFERENCE TO RELATED APPLICATION

This application claims priority to Great Britain Application No. 0602015.0, filed 1 Feb. 2006, and such application is hereby incorporated by reference as if fully disclosed herein.

BACKGROUND OF THE INVENTION

1. Field of the Invention

The present invention relates to blinds and in particular to Venetian blinds for use primarily at windows but also suitable for use with glazed doors and other like locations. The invention also relates to components used in the manufacture of such blinds and to methods of manufacture or assembly of such blinds.

2. Description of the Relevant Art

Venetian blinds, which are also known as slatted blinds, are well known and conventionally comprise an upper supporting structure in the form of a head rail from which depend two or more spaced apart ladders. The ladders comprise a pair of longitudinal cords or threads aligned in use substantially parallel to the window with a plurality of lateral threads interconnecting the longitudinal cords at regular intervals. The lateral threads support respective laths or slats which form the shading part of the blind. The slats may rest on the lateral threads without any attachment, or some or all of the slats may be directly connected to respective lateral threads.

Mechanisms are conventionally provided by which the blind can be raised and lowered so that it can adopt configurations in which the window is wholly shaded, partially shaded or unshaded. Such mechanisms will normally include at least one lift cord which may pass through holes defined in the slats of the blind. Also, mechanisms are provided by which the slats can be tilted or inclined out of a nominally horizontal alignment into alignments tending towards the vertical, thereby to vary the degree of shading provided by the blind. Tilting is conventionally effected by adjusting the configurations of the longitudinal cords of the ladders. Examples of such mechanisms known from the prior art include the following:

EP 0 976 908 teaches a relatively simple arrangement in which two ladders are provided. The longitudinal cords of the ladders pass through respective apertures in the underside of a control box or head rail. The cords are separated on passing through the aperture and secured at spaced apart locations to a control cable. Movement of the control cable in one direction thus causes one cord of a given ladder to be raised while the other is lowered and movement of the control cable in the other direction has the equivalent effect in the opposite sense.

DE 33 13 833 describes an essentially similar arrangement in which a control rod has fixedly mounted thereon cord attachment brackets. The control rod is connected to a rack and worm drive arrangement by which it can be moved laterally, having the same effect on the ladder cords as in EP 0 976 908.

SE 457 978 teaches that the respective ladder cords are attached to opposed sides of slidable plates mounted in a head rail. The plates are caused to slide by means of a user-operated control cord.

U.S. Pat. No. 5,934,351 teaches a blind having a pair of linked sliders arranged to slide along the bottom wall of the head rail. The respective cords of the ladders pass through apertures in the bottom wall and through apertures in the sliders. The individual cords are attached to opposed ends of the sliders. Movement of the sliders under the action of a user operated control cord thus causes tilting of the slats of the blind.

EP 1 431 507 teaches a Venetian blind including a head rail mounted control arrangement. The head rail includes apertures arranged in register with the ladder cords, and bearing blocks mounted at the apertures. A control bar is slidably mounted on the bearing blocks. The control bar has fastening elements attached towards its ends to opposed ends of which respective ends the ladder cords are attached. The control bar is attached to a rack and pinion arrangement which is in turn moveable by a user operated control wand.

BRIEF SUMMARY OF THE DISCLOSURE

The present invention seeks to provide an improved control arrangement for a Venetian-type blind which includes components which are easily manufactured and which facilitate assembly of the blind. The present invention further seeks to provide a blind including said control arrangement and a method of assembling a blind including said control arrangement.

According to a first aspect of the present invention, there is provided a Venetian-type blind comprising:

i) a plurality of slats;

ii) a support structure including a wall defining an aperture therein;

iii) a cord ladder by which the slats are supported, the cord ladder comprising a pair of cords and a plurality of slat-supporting lateral threads extending between the longitudinal cords;

iv) a slider element disposed in the support structure, the slider element comprising:

a) a base portion mounted in fixed relation to the aperture; and b) a slider portion attached to the base portion, having opposed first and second ends and operably slidably moveable with respect to the base portion between a middle position and any of a range of positions in opposed first and second directions, wherein the cords of the ladder pass through the aperture in the support structure;

the base portion and the slider portion include surfaces which are configured to define at least one void between the base portion and the slider portion;

the base portion defines first and second spaced apart through holes;

each ladder cord is routed through a respective through hole in the base portion and through said void; and an upper end portion of one of the ladder cords is secured to the slider portion proximate the first end thereof and an upper end portion of the other of the ladder cords is secured to the slider portion proximate the second end thereof; whereby movement of said slider portion in the first direction tilts the slats in one direction and movement of the slider portion in the second direction tilts the slats in an opposite direction.

Preferably the slider portion is slidably moveable with respect to the base portion along a substantially linear path.

In one particular embodiment, the slider portion comprises a top wall and first and second side walls depending from the top wall and arranged substantially parallel to the linear path of movement of the slider portion, said void being defined by inner surfaces of said top wall and side walls.

In a particular configuration, the slider element further comprises a dividing wall configured to divide the void into first and second chambers, and wherein one of the ladder cords is routed from its through hole in the base portion through the first chamber and the other of the ladder cords is routed from its through hole in the base portion through the second chamber. The dividing wall is preferably substantially linear and arranged parallel to the linear path of movement of the slider portion.

Preferably the dividing wall depends from the top wall of the slider portion.

In a particularly preferred arrangement, the slider element comprises a further dividing wall whereby the void is divided into first, second and third chambers. In this embodiment also, preferably each dividing wall is substantially linear and arranged parallel to the linear path of movement of the slider portion. Preferably the dividing walls depend from the top wall of the slider portion.

In preferred configurations of this aspect of the invention each through hole of the base portion is arranged in registry with a respective chamber.

Preferably the blind further comprises a lift or support cord configured to facilitate raising or lowering of the slats, and the base portion includes a third hole through which the lift cord is routed into the void.

Preferably, where the slider element comprises three chambers, the first chamber is defined between a first side wall of the slider portion and a first dividing wall, the second chamber is defined between a second side wall of the slider portion and a second dividing wall and the third, central, chamber is defined between the first and second dividing walls, one of the ladder cords is routed from its through hole in the base portion through the first chamber to the first end of the slider portion and the other of the ladder cords is routed from its through hole in the base portion through the second chamber to the second end of the slider portion.

Preferably the third hole of the base portion is in register with the third chamber and the lift or support cord is routed from the third hole through the third chamber.

Preferably the slider portion further comprises a first end wall section configured to close the first chamber at the second end of the slider portion, and a second end wall portion configured to close the second chamber at the first end of the slider portion.

Preferably the base portion includes projecting stop formations which cooperate with the respective end wall sections to limit movement of the slider portion with respect to the base portion.

Preferably the top wall of the slider portion defines a longitudinal slot in registry with the third hole through which slot a lift or support cord for the slats may operatively pass.

In preferred configurations, ladder cord securing means are provided on a top surface of the top wall of the slider portion. Preferably the ladder cord securing means are formed integrally with the slider portion.

Preferably the ladder cord securing means include a securing member which is attached to the slider portion by means of a living hinge.

Preferably the base portion and the slider portion include cooperating formations by which the slider portion is attached to the base portion. Preferably the formations of the base portion and/or of the slider portion are sufficiently resiliently deformable to allow the base portion to "push fit" or "snap fit" on the slider portion after the ladder cords have been threaded through the holes in the base portion.

In a particularly preferred embodiment of this aspect of the invention, the slider element and the aperture are respectively so sized that the slider element may be passed through the aperture when in an orientation other than its final orientation of use and may not be passed through the aperture when in said final orientation of use.

In some preferred configurations, the blind according to this aspect of the invention includes a plural number of cord ladders and the same plural number of slider elements, the cords of each cord ladder being attached to a respective slider element. Preferably in this configuration the blind includes at least one connector by which the slider portions of the slider elements are connected, whereby the slider portions of the slider elements are moveable in unison.

Preferably, the base portion is seated in the aperture, such as by means of a "snap fit" construction of the base portion.

According to a second aspect of the invention there is provided a method of assembling a Venetian blind, the blind comprising:

i) a plurality of slats;

ii) a support structure including a wall defining an aperture therein;

iii) a cord ladder by which the slats are supported, the cord ladder comprising a pair of cords and a plurality of slat-supporting lateral threads extending between the longitudinal cords;

iv) a slider element, the slider element comprising:

a) a base portion configured to be mounted in fixed relation to the aperture and defining first and second spaced apart through holes; and b) a slider portion attachable to the base portion, having opposed first and second ends and operably slidably moveable with respect to the base portion between a middle position and any of a range of positions in opposed first and second directions, the base portion and the slider portion including surfaces which, when operatively the base portion is attached to the slider portion, are configured to define at least one void between the base portion and the slider portion the method including the steps of:

feeding upper end regions of the ladder cords through the respective through holes of the base portion;

attaching the base portion to the slider element and locating the ladder cords so that they pass through the void so formed; and attaching respective upper end portions of the ladder cords to respective end portions of the slider portion.

Preferably the slider portion is slidably moveable with respect to the base portion along a substantially linear path.

Preferably the method of this aspect of the invention further comprises the steps of passing the slider element through the aperture and adjusting the slider element to a use orientation in which it cannot pass through the aperture.

According to a third aspect of the invention there is provided a slider element for use in adjusting the angle of tilt of the slats of a Venetian blind comprising:

a) a base portion and b) a slider portion attached to the base portion, having opposed first and second ends and operably slidably moveable with respect to the base portion between a middle position and any of a range of positions in opposed first and second directions, wherein, the base portion and the slider portion include surfaces which are configured to define at least one void between the base portion and the slider portion;

the base portion defines first and second spaced apart through holes for the passage of ladder cords; and the slider portion comprises first and second ladder cord securing means disposed proximate respective ends thereof.

Preferably the slider portion is slidably moveable with respect to the base portion along a substantially linear path.

Preferably the slider portion comprises a top wall and first and second side walls depending from the top wall and arranged substantially parallel to the path of movement of the slider portion, said void being defined by inner surfaces of said top wall and side walls.

Preferably the slider element further comprises a dividing wall configured to divide the void into first and second chambers, each chamber communicating with a respective through hole.

Preferably slider element also comprises a further dividing wall whereby the void is divided into first, second and third chambers.

Preferably the first chamber is defined between a first side wall of the slider portion and a first dividing wall, the second chamber is defined between a second side wall of the slider portion and a second dividing wall and the third, central, chamber is defined between the first and second dividing walls.

Preferably the slider portion further comprises a first end wall section configured to close the first chamber at the second end of the slider portion, and a second end wall portion configured to close the second chamber at the first end of the slider portion.

Preferably the base portion includes projecting stop formations which cooperate with the respective end wall sections to limit movement of the slider portion with respect to the base portion.

According to a fourth aspect of the invention there is provided a Venetian-type blind including a slider element according to the third aspect of the invention.

According to a fifth aspect of the invention there is provided a support assembly for a Venetian-type blind comprising a support structure including a wall defining at least one aperture therein and at least one slider element as defined in the third aspect of the invention, the base portion of the or each slider element being operatively located at or in a respective aperture.

According to a sixth aspect of the invention there is provided a kit of parts for the manufacture, assembly or installation of a Venetian-type blind, the kit including at least one slider element according to the third aspect of the invention. Preferably the kit of parts further comprises a support structure including a wall defining at least one aperture, the base portion of the or each slider element being operatively locatable at or in a respective aperture.

Alternatively the kit of parts may further comprise one or more components selected from the group comprising:

(a) a support structure including a wall defining at least one aperture, the base portion of the or each slider element being operatively locatable at or in a respective aperture;
(b) one or more cord ladders the respective cords of which are operatively connectable to a respective slider element;
(c) a plurality of slats;
(d) at least one connector by which the slider portions of respective slider elements may operatively be connected;
(e) end caps operatively attachable to end portions of a support structure for providing an aesthetically pleasing finish and/or for routing operating cords;
(f) one or more operating cords and/or one or more lift cords;
(g) a bottom rail or foot rail;
(h) one or more tensionable supporting cords.

BRIEF DESCRIPTION OF THE DRAWINGS

For a better understanding of the invention and to show how the same may be carried into effect, reference will now be made, by way of example only, to the following drawings in which.

DETAILED DESCRIPTION

Figure 1:
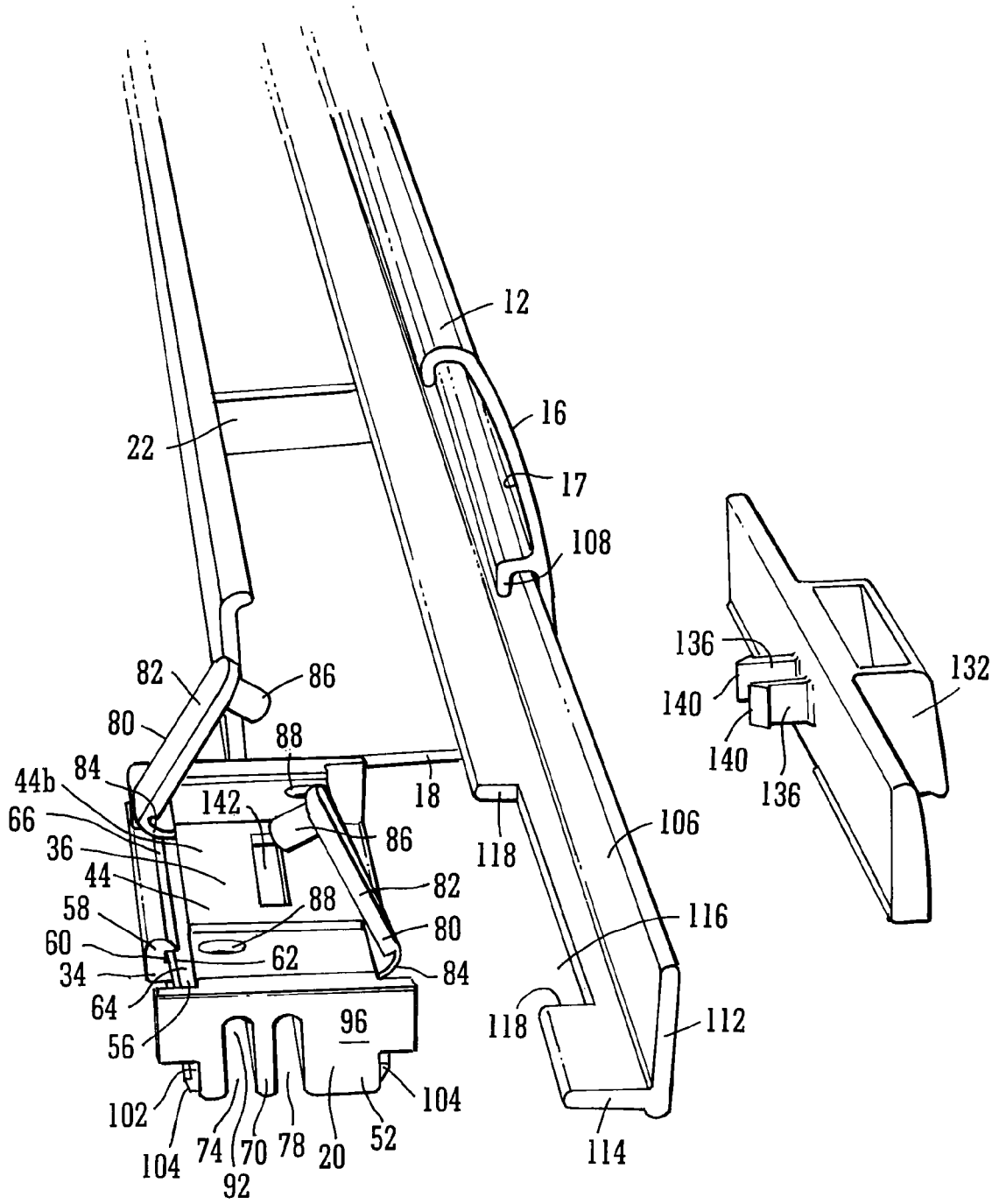
FIG. 1 is an exploded view of a head rail assembly according to one embodiment of the invention.
Figure 2:
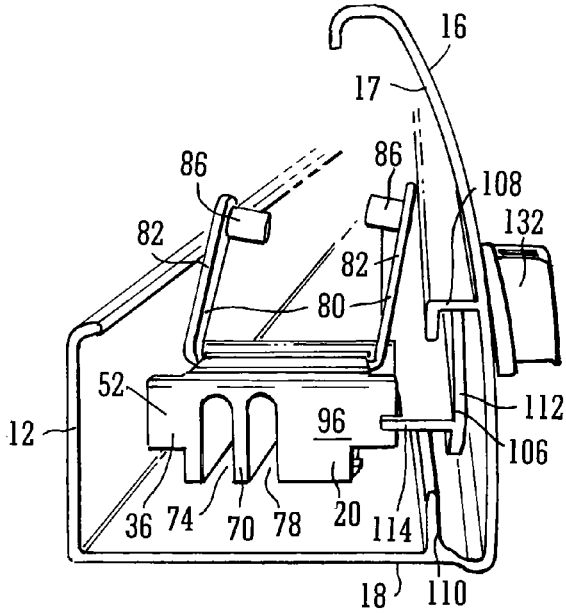
FIG. 2 is an end view of the assembled head rail assembly of FIG. 1.
Figure 3:
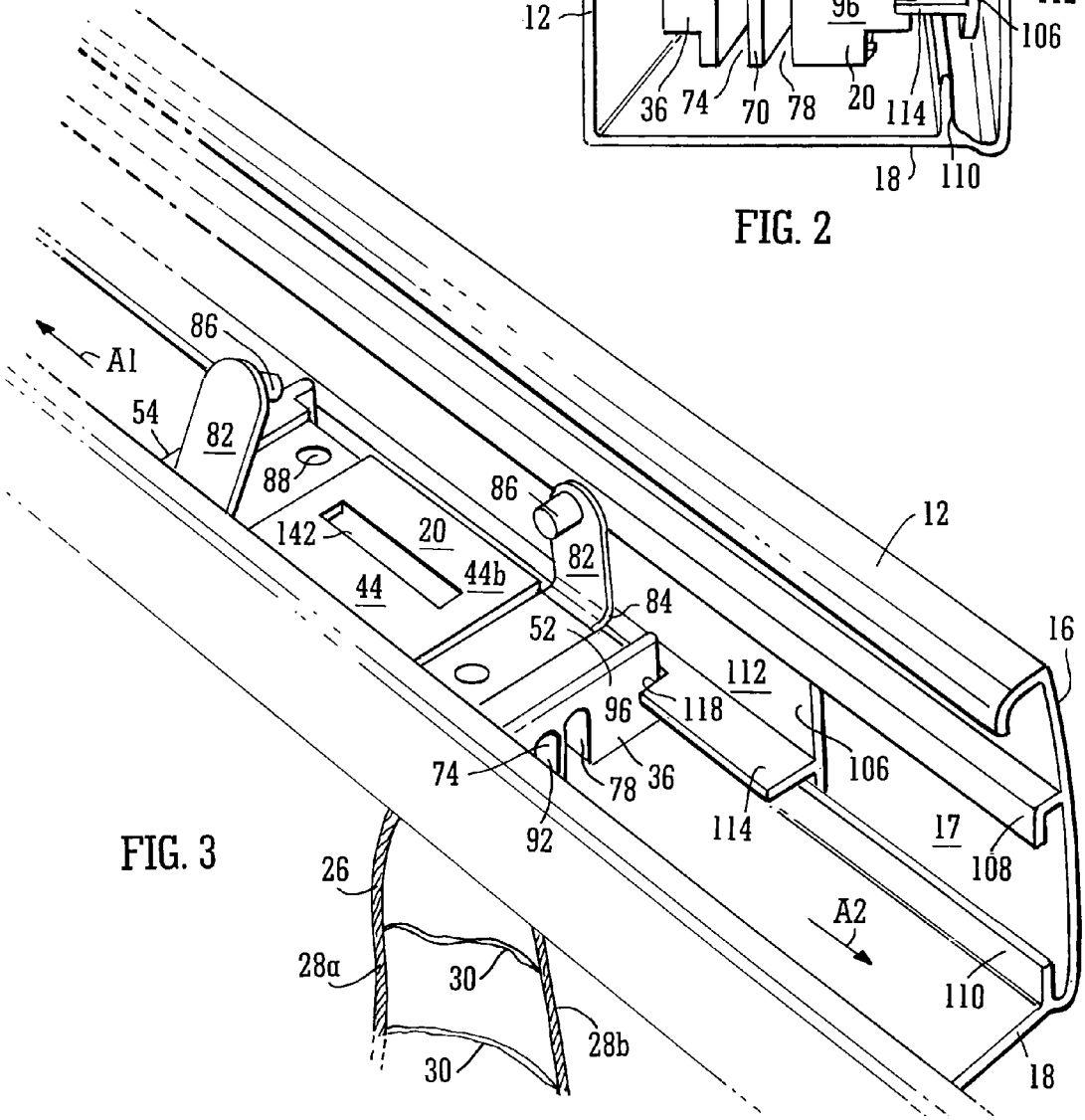
FIG. 3 is a perspective view of the head rail of FIG. 2.

Referring now to the drawings, the blind 10 according to the invention comprises a support structure which is normally a head rail 12 which includes the tilt mechanism for the slats of the blind. In alternative constructions the support structure may be separate from the head rail. For example, the blind may include a fixed head rail and a support structure in the form of a control rail mounted below the head rail and moveable between a range of positions below the head rail. The control rail in this case includes a tilt mechanism for the slats of the blind. In the following description, the support member is described in relation to a head rail 12 including the tilt mechanism. A person skilled in the art will readily appreciate such modifications as may be necessary to incorporate the tilt mechanism in a moveable control bar.

The head rail 12 is conventionally mounted towards the top of a window or of a door panel. For example, the head rail 12 may be secured to a suitable fixing element such as a lintel, or, as in the examples illustrated, may be secured directly or indirectly to the window frame 200. The blind may desirably further comprise end caps 14*a*, 14*b* which engage end portions of the head rail 12 and, in addition to providing an improved aesthetic finish to the blind, may include fixing locations for securing the blind in its position of use. An end cap 14*a* or 14*b* may further include internal formations for guiding the path of operating cords, lift cords and the like. The blind 10 will usually further comprises a bottom rail or foot rail 13 which may be provided with end caps 15*a*, 15*b*. Depending on the particular construction of the blind, the bottom rail 13 may, or may not, be fixedly secured to a fixed element such as the window frame 200. In the illustrated embodiments, the foot rail is not fixedly secured. Depending, again, on the particular construction of the blind, tensioned supporting cords may be provided extending from the head rail 12 to and through the foot rail 13 and terminating in mounting plugs 146 fixedly located in the window frame 200.

The head rail 12 is conveniently a metal or plastic extrusion which presents an external front surface 16 and lower surface 18 of pleasing aesthetic appearance. Operating components of the blind 10 including at least one slider element 20 are located within the head rail 12. The lower surface 18 of the head rail 12 defines at least one aperture 22. The aperture 22 may in principle take the form of a longitudinal slot formed in the underside of the head rail 12. However, such a construction is aesthetically, and practically, less desirable. Most preferably, a plurality of discrete apertures 22 is provided at intervals along the length of the head rail 12.

The blind 10 further comprises a number of slats which are commonly arranged in a substantially horizontal attitude parallel to the window pane. The slats are supported by at least one cord ladder 26. Usually, at least two cord ladders 26 are provided spaced apart at regular intervals with respect to the length of the slats. Clearly, wider blinds will normally require more cord ladders 26. The cord ladder 26 comprises two supporting cords 28*a*, 28*b* which when the blind 10 is disposed conventionally at a vertical window are also arranged substantially vertically. Blinds according to the invention are, of course, not only suitable for use with vertical windows, but may also be used with non-vertical windows such as roof windows. In these cases, the cords of the cord ladders are arranged in use substantially parallel to the window. For convenience of description, the blind 10 is further described in relation to the most common arrangement where the cords 28*a*, 28*b* are nominally vertical. The cord ladder further comprises a plurality of regularly spaced lateral threads 30 which join the two cords 28*a*, 28*b*. Each slat 24 of the blind 10 is supported on a lateral thread 30 of the cord ladder 26. Upper end portions of the cords 28*a*, 28*b* pass through the apertures 22 of the head rail 12. Usually, the upper end portions of the cords 28*a*, 28*b* are connected to a tilt mechanism in the head rail 12 by which the angle of inclination of the slats 24 can be varied, as will be described below. The foot rail 13 then provides a fixing point for the cords 28*a*, 28*b*, for example by means of fixing components 144 to which the cords 28*a*, 28*b* are attached and which are, in turn, fixedly attached to the foot rail 13. If the foot rail is fixedly located, then the fixing of the cords 28*a*, 28*b* must be such as to allow movement of the cords 28*a*, 28*b* required for tilting of the slats 24. The fixing components 144 may also serve to secure the lower ends of lift cords, if present, or for routing of lift cords or tensioned support cords within the foot rail 13. The slats can be set, by movement approximately about their horizontal axes, in any of a range of positions from the nominally horizontal (in which the window is not obscured) to positions at or towards the vertical in which the window is completely, or almost completely, shaded by the slats 24.

Figure 13:
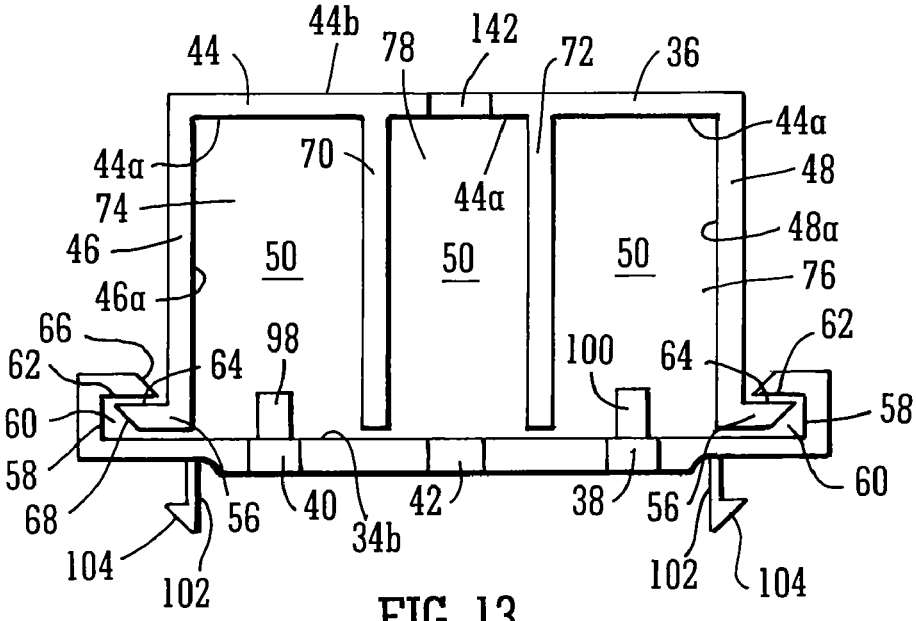
FIG. 13 is a schematic cross section along line B-B of FIG. 10.

The tilt mechanism for the slats 24 includes at least one slider element 20 to which the cords 28*a*, 28*b* of the cord ladder 26 are attached. The slider element 20 comprises a base portion 34 which is located in a fixed position relative to the head rail 12 and a slider portion 36 which is moveable relative to the base portion 34. In an assembled blind, the base portion is located over or in the aperture 22. Preferably the base portion 34 is seated in the aperture 22 so that the lower surface 34*a* of the base portion 34 is at least approximately flush with the external lower surface 18 of the head rail 12. Preferably the base portion 34 is constructed so that it is a snap fit in the aperture 22. For example the base portion may be provided with opposed parallel walls 102 which depend downwardly from the base portion and which include laterally projecting latching formations 104 which latch with the edges of the aperture defined by lower face 18 of the head rail 12. The size of the latching formations 104 is exaggerated for clarity in FIG. 13.

Figure 4:
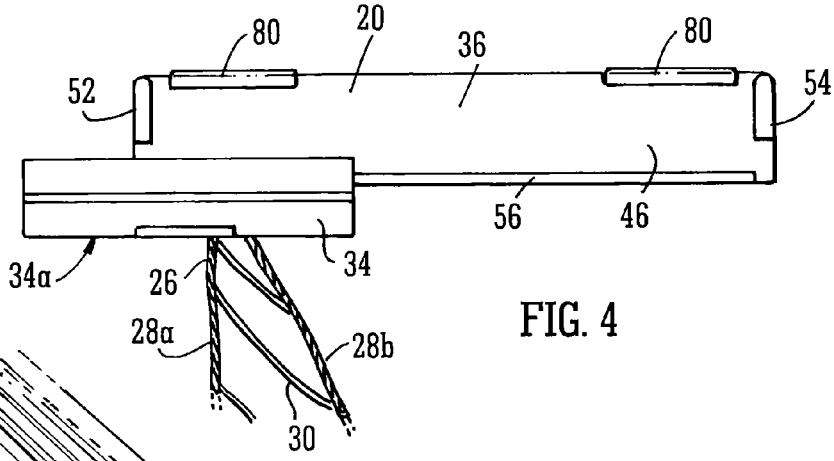
FIG. 4 shows a side view of a slider element according to the invention.
Figure 8A:
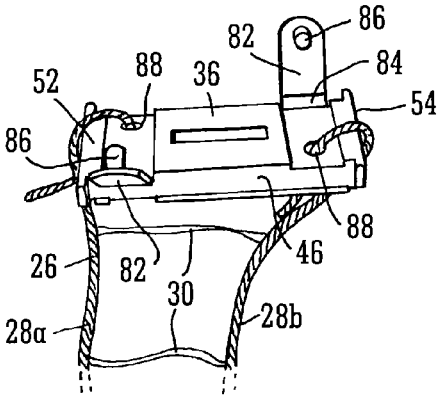
FIGS. 8A, 8B and 8C show steps in the attachment of a ladder cord to the slider element of the invention.
Figure 8B:
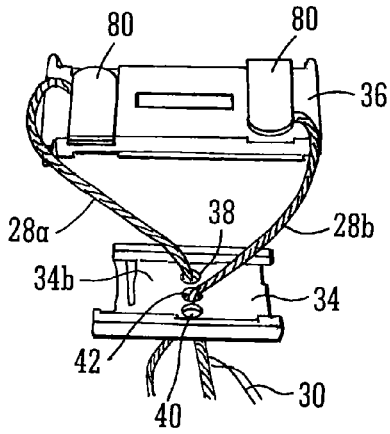
Figure 8C:
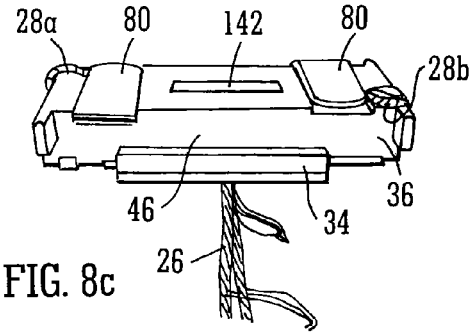
Figure 9:
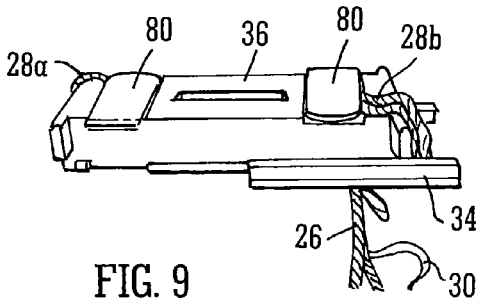
FIG. 9 is a perspective view of a slider element according to the invention with a ladder cord attached.
Figure 10:
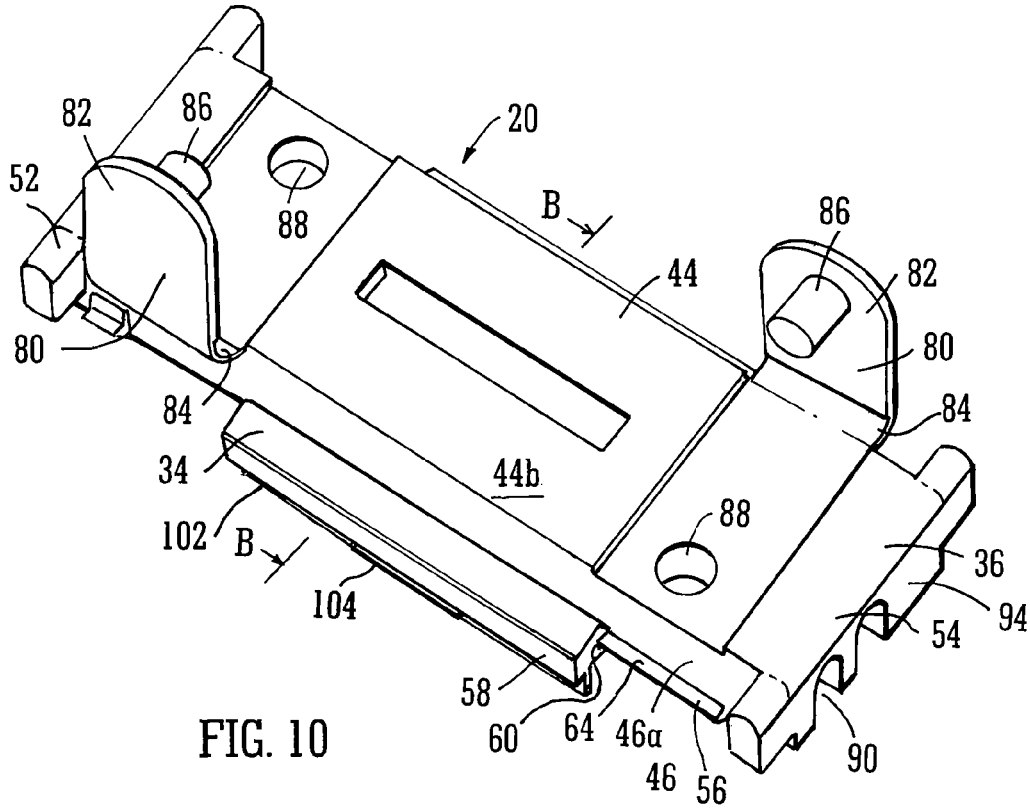
FIG. 10 shows a perspective view of a slider element according to the invention.
Figure 11:
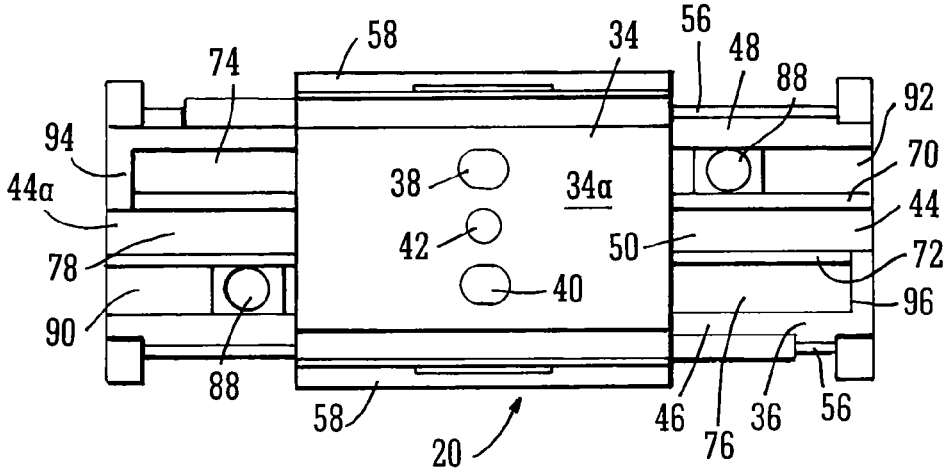
FIG. 11 shows an underneath plan view of a slider element according to the invention.

The slider portion 36 is moveable with respect to the base portion 34 along a substantially linear path which extends substantially parallel to the major axis of the head rail 12, as indicated by arrows Al and A2. The slider portion 36 is moveable from a middle position (FIG. 8*c*) in which it is centrally located with respect to the base portion 34 (or, considered alternatively, in which the base portion 34 is centrally located with respect to the slider element) either in a first direction or in a second direction opposed to the first direction. A user can set the slider portion 36 in the middle position or in any intermediate position. The middle position of the slider portion 36 will normally correspond to the horizontal setting of the slats (i.e. no tilt) and the maximum displacement of the slider portion 36 (FIG. 4, FIG. 9) in either of the first or second directions will normally correspond to the maximum degree of tilt of the slats in a respective direction.

The base portion includes first and second through holes 38, 40, and preferably also a third through hole 42. In the finished blind, a first of the cords 28*a* of the cord ladder 26 typically passes through a first through hole 38 and a second of the cords 28*b* typically passes through the second through hole 40. This arrangement allows a tensioned operating cord or lift cord to pass through middle hole 42. Where the lift cord or operating cords is not present, the cords 28*a*, 28*b* may pass through any two of the holes 38, 40, 42. In the embodiment illustrated in FIG. 8*b*, holes 38 and 42 are used for cords 28*a*, 28*b*. In other variations, the lift cord may be arranged at the rear of the slats 24 and the slats 24 may be provided with a small indentation at their rear edge (nearest the window glass) to accommodate this. In this construction, it is advantageous for the lift cord to pass through the hole (e.g. hole 38) which is operatively located nearest the window glass, and for the cords 28*a*, 28*b* or the cord ladder 26 to pass through the other two holes 40, 42.

The slider portion 36 comprises a top wall 44 and side walls 46, 48 which depend from the top wall 44. The top wall 44 has an internal surface 44*a* and side walls 46, 48 have internal surfaces 46*a*, 48*a*. Base portion 34 has an upper surface 34*b*. Together surfaces 44*a*, 46*a*, 48*a* and 34*b* defined a void, hollow or cavity 50 through which the cords 28*a*, 28*b* of the cord ladder 26 are routed after passage through the through holes 38, 40 of the base portion. A first of the cords 28*a* is routed through the void 50 to a first end 52 of the slider portion 36 and secured to the slider portion 36 proximate the first end 52. A second of the cords 28*b* is routed through the void to a second end 54 of the slider portion 36 and secured to the slider element 36 proximate the second end 54. Thus, movement of the slider portion 36 with respect to the base portion 34 in one direction along the substantially linear movement path causes one of the cords 28*a* to be raised and the other of the cord 28*b* to be lowered to the same extent, thus tilting the slats 24. Movement of the slider portion 36 in the opposite direction has the opposite effect, that is, the cord 28*b* is raised and the cord 28*a* is lowered, so that the slats 24 are tilted in the opposite sense.

The slider portion 36 is attached to the base portion 34 of the slider element 20 by means of co-operating formations which secure the slider portion 36 and the base portion 34 together while allowing the slider portion 36 to slide with respect to the base portion 34. In the embodiments illustrated, the slider portion 36 includes laterally projecting wings 56 which extend along the majority of the length of side walls 46, 48. Base portion 34 includes opposed channel defining formations 58 which preferably extend along its entire length. The formations 58 define opposed channels or grooves 60 in which the projecting wings 56 of the slider portion 36 are received and retained. The formations 58 define a surface 62 which is maintained in sliding contact, or at least in close proximity, with an upper surface 64 of the projecting wings 56. The channel defining formations 58 and/or the projecting wings 56 are resiliently deformable to an extent sufficient to allow the base portion 34 to be snap fitted to the slider portion 36. To facilitate the snap-fitting, the projecting wings 56 and channel defining formations 58 include complementary chamfered surfaces 66, 68.

The slider element 36 further includes at least one dividing wall 70. Preferably, two dividing walls 70, 72 are provided so that the void is divided into two or, preferably three chambers 74, 76, 78. The dividing walls 70, 72 depend from top wall 44 of the slider portion 36 and extend parallel to the linear movement path of the slider portion 36. Thus the chambers 74, 76, 78 are parallel to one another and extend along substantially the whole length of the slider portion 36. The dividing walls 70, 72 and the side walls 46, 48 terminate in approximately the same plane. Thus ends 70*a*, 72*a* of the walls 70, 72 are in close proximity to the upper surface 34*b* of the base portion. In alternative embodiments, the dividing walls 70, 72 could extend from the base portion 34.

Each of the through holes 38, 40, 42 communicates with only one of the chambers 74, 76, 78. Preferably the cords 28*a*, 28*b* of the cord ladder 26 pass through the outer through holes 38, 40 of the base portion and respectively into outer chambers 74, 76, although if no lift cord or tensioned support cord is present, any two of the holes 38, 40, 42 may be used. If present, a lift cord used for raising and lowering the slats 24 or a tensioned support cord passes through central hole 42 and into, or through, central chamber 78. Preferably the through holes 38, 40, 42 are arranged along a line perpendicular to the linear movement path of the slider portion. Preferably, the third through hole 42 is arranged substantially on the center line of the slider element 36 and the first and second through holes 38, 40 are arranged equidistantly to either side. Thus, the cords 28*a*, 28*b*, and the lift cord or tensioned support cord (if present), are routed entirely separately through the slider element 20 along different paths. In other words, each chamber 74, 76 (and optionally 78) includes only a single cord 28*a*, 28*b* (or lift cord) so that there is no possibility of the cords becoming tangled or otherwise interfering with one another.

As noted above, after being routed through the void 50, the cords 28*a*, 28*b* are secured proximate opposed first and second ends 52, 54 of the slider portion 36. Cord securing means are provided on the slider element 36. In principle any suitable and cord securing means may be used. A particularly preferred form is illustrated in the Figures in which the cord securing means 80 are arranged at the upper surface 44*b* of the slider portion top wall 44. Preferably a cord securing means is provided for each of the cords 28*a*, 28*b*, located at or near the ends 52, 54 of the slider portion 36. In the illustrated embodiment each securing means 80 comprises a securing arm 82 which is moveable about a hinge 84, in particular a living hinge, between an open position and a closed position in which the arm captures an end part of the cord 28*a* or 28*b* and engages the body of the slider portion 36 to retain the cord 28*a*, 28*b*. In a preferred configuration the arm 84 includes a spigot or pin 86 and the top wall 44 of the slider portion 36 includes a corresponding hole 88 into which the pin 86 is inserted when the arm 84 is in its closed position. The pin 86 is frictionally retained in the hole 88 to keep the arm 84 in its closed position. In a particularly preferred configuration the cords 28*a*, 28*b* of the cord ladder 26 are routed out of their respective chambers 72, 74 through open ends 90, 92 of the chambers 72, 74 at ends 52, 54 of the slider portion 36. The cords 28*a*, 28*b* are then routed round the respective ends 52, 54 of the slider portion 36 and onto the upper surface 44*b* where they are secured by respective cord securing means 80. Preferably the ends of the cords 28*a*, 28*b* are routed into holes 88 to be frictionally engaged by pins 86. The holes 88 are preferably through holes so that the endmost parts of the cords 28*a*, 28*b* re-enter the void 50.

Movement limiting means are provided to limit the extent of the translational movement of the slider portion 38 with respect to the base portion 34 in the first and second directions. In the advantageous form as illustrated, the chambers 72, 74 at their ends opposite to that to which the respective cord 28*a*, 28*b* is routed are closed by end walls 94, 96 which depend from top wall 44. Thus end wall 94 is provided at the end of chamber 74 at the second end 54 of the slider portion and end wall 96 is provided at the end of chamber 78 at the first end 52 of the slider portion. End walls 94, 96 terminate in approximately the same plane as dividing walls 70, 72 and side walls 46, 48. Base portion 34 is provided with stop formations 98, 100 in the form of short fingers which project upwardly from the upper surface 34*b* of the base portion 34. The fingers 98, 100 are located so that as the slider portion 36 moves in the first direction, the finger 98 ultimately contacts the end wall 94 so limiting the movement of the slider portion 36 in the first direction and similarly as the slider portion 36 moves in the second direction, the finger 100 ultimately contacts the end wall 96 so limiting the movement of the slider portion 36 in the second direction.

Most Venetian blinds will include more than one cord ladder. Typically two, three, four or more cord ladders are provided, usually spaced at regular intervals along the length of the slats 24. Longer slats 24 require more cord ladders 26. The cords 28*a*, 28*b* of each cord ladder 26 are secured to individual slider elements 20 disposed within the head rail 12, each slider element being located at a corresponding aperture 22. In order to tilt the slats 24 it is important that the slider portions 36 of the slider elements 20 are moved in unison, so that the cords 28*a*, 28*b* of each cord ladder 26 are raised/lowered to the same extent and at the same time. To this end the slider portions 36 of the slider elements 20 are linked together by suitable linking means. Depending what means are provided for a user to move the slider portions 36, the linking means may be as simple as inextensible cords which are arranged to connect each slider portion 36 to an adjacent slider portion 36. However, in the preferred arrangement as illustrated, the blind according to the invention is provided with a slider operating bar 106 which engages the slider portions 36.

The operating bar 106 is disposed within the head rail 12 and is preferably constrained to move along a linear path. To this end, the head rail 12 is provided on an inner face 17 with opposed channel defining formations 108, 110 in which the operating bar 106 is held captive but free to move linearly substantially parallel to the major axis of the head rail 12. The operating bar 106 comprises a first planar portion 112 which is held captive in the channel defining formations 108, 110 and a second planar portion 114 which depends from the first planar portion 112. Typically, but not essentially, the second planar portion 114 is configured to be substantially perpendicular to the first planar portion 112 and may be of substantially the same length. The second planar portion 114 includes means by which the operating bar 106 engages the, or each, slider portion 36. In the preferred arrangement, the second planar portion includes recesses or cut-outs 116 which are sized to conform to the length of the slider portion 36, so that the slider portion 36 operatively sits in the recess 116. The second planar portion 114 defines opposed side edges 118 of the recess 116 which are in confronting relation with ends 52, 54 of the slider portion 36, such as end walls 94, 96 or ends of dividing walls 70, 72. Thus, movement of the operating bar 106 in either possible direction results in a corresponding movement of the, or each, slider portion 36.

Other means by which the operating bar 106 may engage the slider portion 36 are possible. For example, the second planar portion 114 may be discontinuous, so that it is absent in regions intermediate the slider elements 20. Alternatively, the second planar portion 114 may be entirely absent and pins, pegs or other projecting formations may be provided on the first planar portion 114 for engagement with the slider portion 36.

Figure 12:
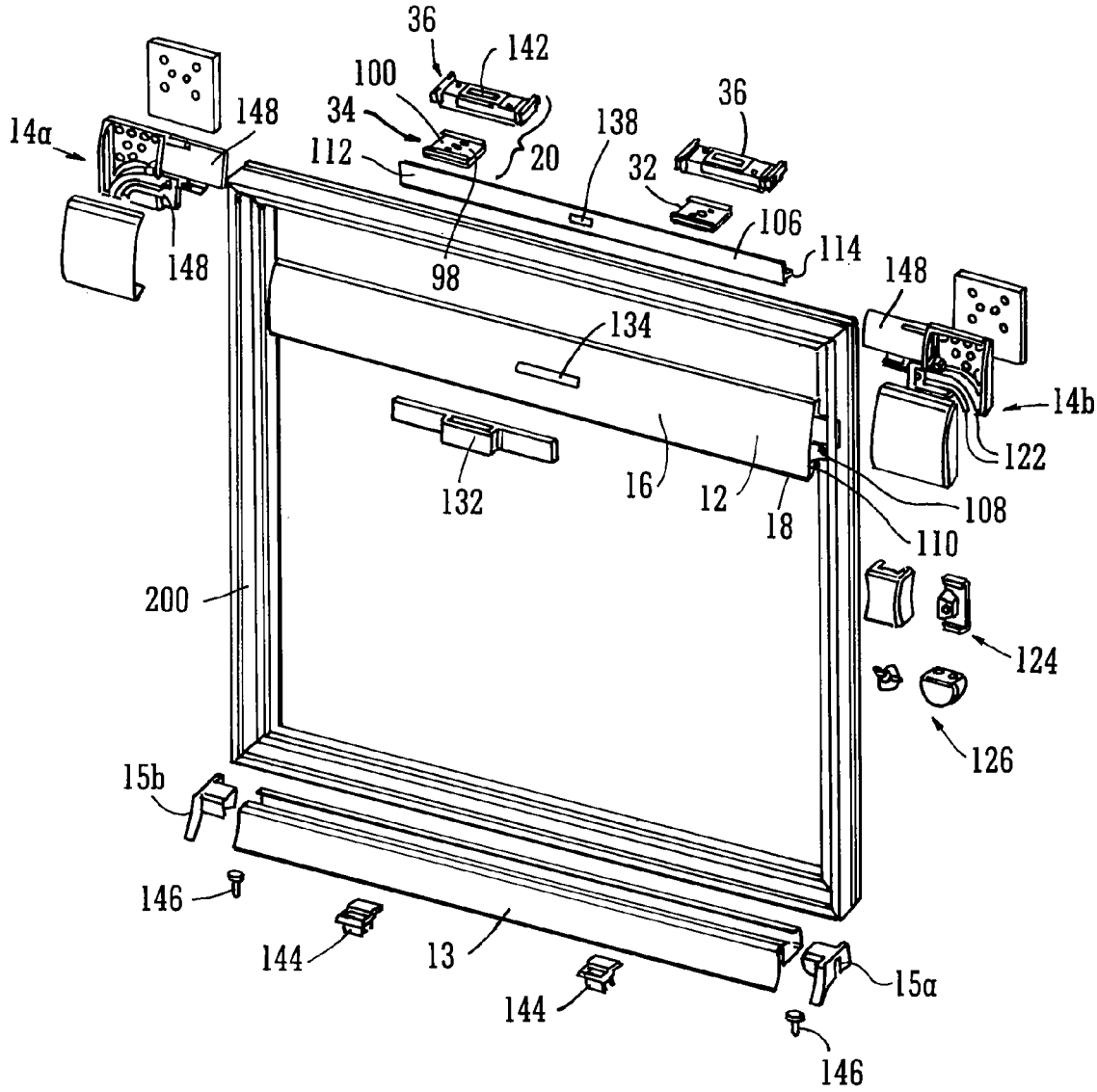
FIG. 12 is an exploded view showing major components of the blind according to the invention.

Movement of the operating bar 106 and hence of the, or each, slider portion 36 is under the control of the user of the blind 10. Hence, means must be provided by which the user can move the operating bar 106 and slider element(s) 36. Such means can take various forms. For example, an operating cord 120 may be provided having a first end attached to one end of the operating bar 106 and a second end attached to the other end of the operating bat 106 and routed through an eye or around a guiding formation of the end cap 14*a* (or equivalent formation of the head rail 12). The operating cord is routed out of the head rail 12, conveniently through one of the end caps 14*a*, 14*b* (in FIG. 12, the cord 120 is routed through end cap 14*b*) which may preferably include internal formations 122 for guiding the path of portions of the operating cords. Means 124, 126 for retaining the operating cord 120 in a convenient location with respect to the blind 10 and the window 200 may also be provided. Thus, when a user pulls on an external first length 128 of the operating cord 120, the operating bar 106 and slider portions 36 are moved in a first direction and the slats 24 of the blind 10 are tilted in a first sense. Similarly, when a user pulls on an external second length 130 of the operating cord 120, the operating bar 106 and slider portions 36 are moved in a second direction and the slats 24 of the blind 10 are tilted in a second sense. An advantage of this construction is that the length of the operating cord 120 is fixed. Adjustment of the operating cord 120 does not result in any lengthening or shortening of the length of cord 120 external of the head rail. This allows the cord to be retained tidily and safely, in particular by retaining means 124, 126. The cord cannot therefore become tangled with itself or present a tangling hazard for, for example, a young child.

Figure 14:
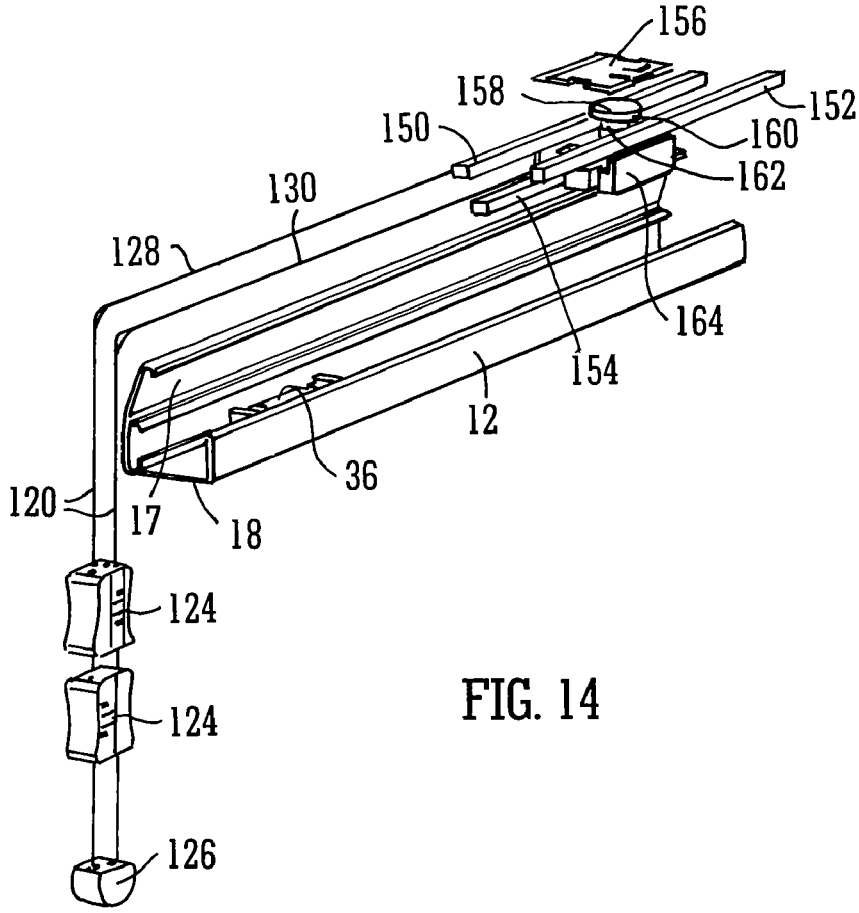
FIG. 14 is an exploded view showing schematically a gearbox arrangement for use in the blind of the invention.

In a variation of this embodiment a gearbox arrangement is interposed between the operating cords 120 and the tilt mechanism. In this way, a proportionately larger movement of the operating cord 120 is required in order to achieve a given movement of the tilt mechanism, thus providing a user with a finer degree of control in the setting of the angle of the slats. An example of a gearbox arrangement is illustrated in FIG. 14 in which respective lengths 128, 130 of the operating cord 120 are connected to slidable members 150, 152 which are retained in the head rail 12. The slidable members 150, 152 engage a first gear wheel 160. For example the slidable members may be toothed (i.e. racks) and engage corresponding teeth of the first gear wheel 160. Alternatively, the slidable members 150, 152 may frictionally engage the first gear wheel 160. In either event, linear motion of the slidable members 150, 152 caused by adjustment of the operating cord 120 by a user is converted into rotational movement of the first gear wheel 160. First gear wheel 160 is fixedly connected to a second, co-axial gear wheel 162 which is of smaller diameter than the first gear wheel 160. Thus, rotational movement of the first gear wheel 160 causes a corresponding rotation of the second gear wheel 162. Second gear wheel 162 engages a third slidable member 154. As for the members 150, 152, the engagement may be frictional, by meshing teeth or otherwise, so that the rotational movement of the second gear wheel 162 is converted into linear movement of the third slidable member 154. The third slidable member may be connected to an operating bar 106, or may be directly connected to the or each slider portion 36 (in which case, the member 154 may replace the operating bar 106). A supporting body 164 is provided in the head rail 12 in which the gear wheels 160, 162 are mounted. A retaining cover or clip 156 is provided to retain gear wheels 160, 162 in position.

An alternative arrangement does not require the operating cord 120. In this arrangement, a user-moveable handle, knob or the like 132 is arranged on the front face 16 of the head rail 12. The head rail 12 includes a longitudinal slot 134 and the handle 132 includes a rearwardly extending member 136 which extends though the slot. The member 135 is attached by suitable means to the operating bar 106. For example, the operating bar 106 may include an aperture 138 and the member 136 may include latching formations 140 which pass through the aperture and engage the first planar portion 112 of the operating bar 106. Thus, movement of the handle 132 by a user results in a corresponding movement of the operating bar 106 and slider portion(s) 36 and consequential tilting of the slats 24.

The construction of the blind according to the invention including the slider element(s) 20 and operating bar 106 is advantageous in allowing a slim head rail 12, that is, the head rail 12 has a relatively smaller top to bottom dimension compared to conventional head rails. For example, the head rail 12 of the invention may have a top to bottom dimension of about 12 mm , compared with a typical dimension of 20 m or more for conventional head rails. Thus the head rail 12 of the invention has greater aesthetic and consumer appeal.

The blind according to the invention may be secured in place by any suitable means. In a preferred arrangement, the head rail 12 is supported by the end caps 14*a*, 14*b* which include lateral projections 148 which are a friction or snap fit with the head rail 12. The end caps 14*a*, 14*b* are conveniently provided with through holes to accommodate fixings such as screws which are used to mount the end caps on an underlying structure, such as a window frame.

Figure 5:
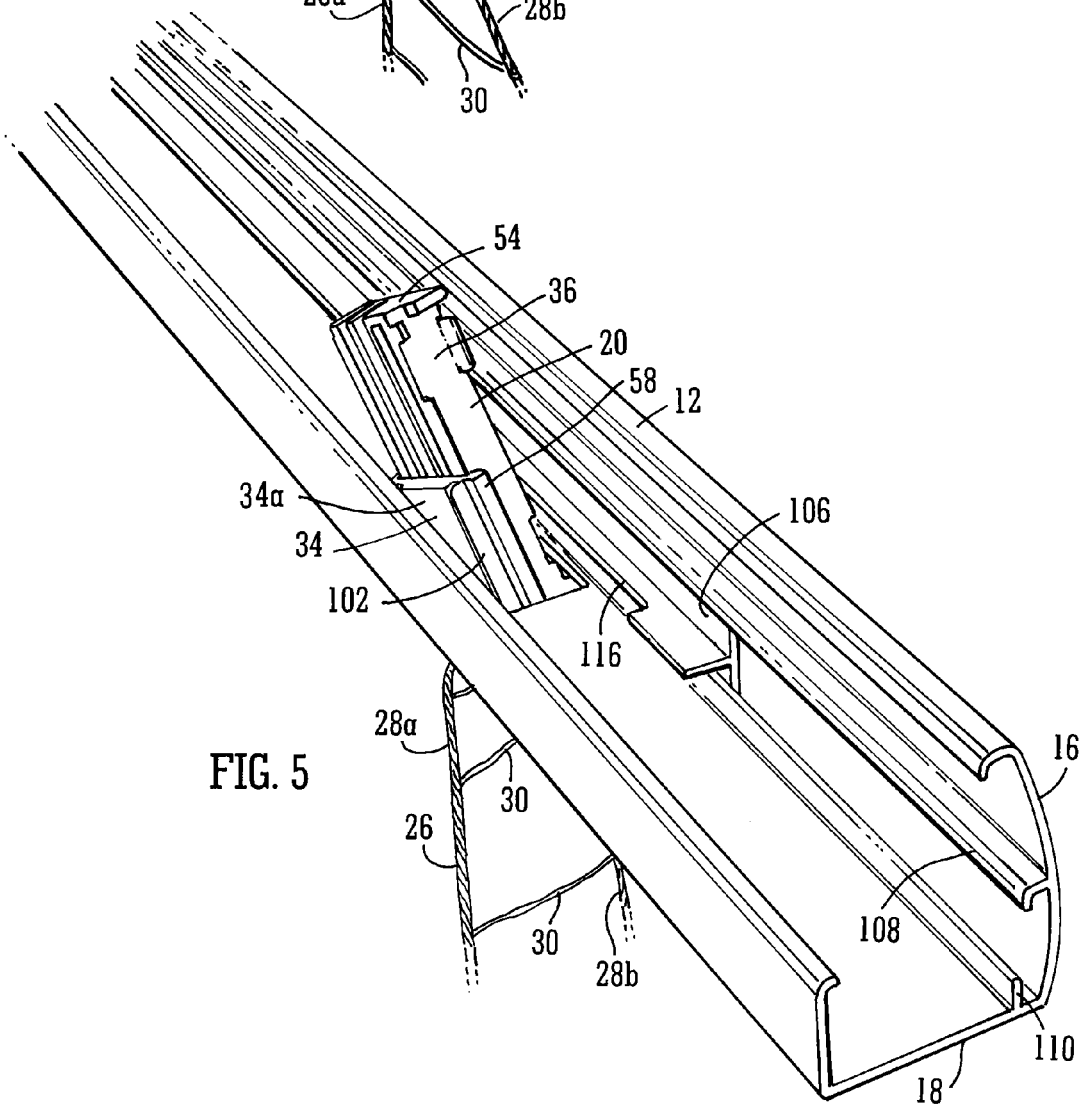
FIG. 5 is a perspective view showing a step in the assembly of a blind according to the invention.
Figure 6:
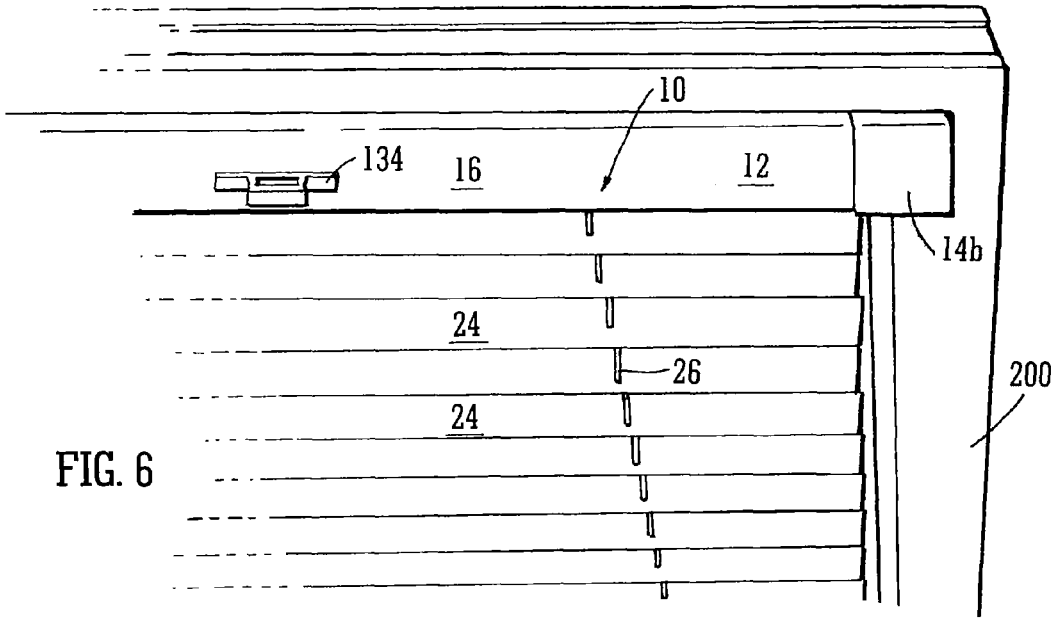
FIG. 6 shows a partial view of completed blind according to one embodiment the invention.
Figure 7:
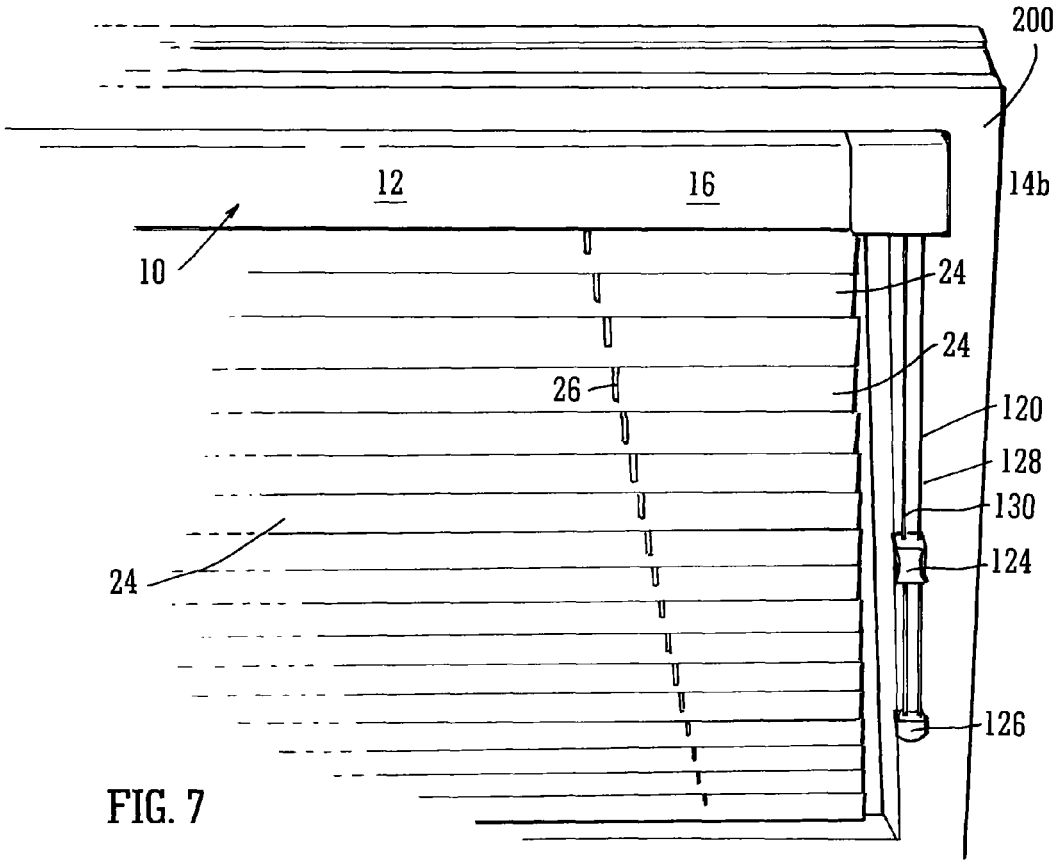
FIG. 7 shows a partial view of completed blind according to another embodiment the invention.

The construction for the blind as described above is especially advantageous in facilitating the manufacture of the blind. Thus, by use of the slider element 20 the production steps of the blind are simplified. A preferred method of constructing the blind according to the invention is as follows, with particular reference to FIGS. 5, 8*a*, 8*b* and 8*c*. Initially, the slider element 20 is supplied in its two separate parts, that is, the base portion 34 and the slider portion 36 (the base portion 34 is omitted for reasons of clarity in FIG. 8*a*). The cords 28*a*, 28*b* of the cord ladder 26 are preferably threaded through the respective through holes 38, 40 of the base portion 34 and, if present the lift cord is threaded through center hole 42 of the base portion 34. In the illustrated embodiment the lift cord is absent and the cords 28*a*, 28*b* are threaded through holes 38, 42. The ladder cords 28*a*, 28*b* are then attached to cord securing means 80 on the slider portion 36. In the preferred construction, the cords 28*a*, 28*b* are threaded into holes 88 in the slider portion 36 and secured by closure of securing arm 82 which thus causes pins 84 to be inserted in holes 88, thereby trapping the cords 28*a*, 28*b*. The length of the cords 28*a*, 28*b* is adjustable by feeding a greater or lesser length of the cords 28*a*, 28*b* through the holes 82. The correct adjustment of the cords will normally be such that, with the slider portion 36 in its middle position with respect to the base portion 34, the lateral threads 30 of the cord ladder 26, and hence the slats 24, are arranged substantially horizontally. The base portion 34 may then be mounted to the slider portion 36, so that the cords 28*a*, 28*b* are located in their respective chambers 74, 76 and the lift cord, if present, is located in the middle chamber 78. If desired, adjustment of the length of the cords 28*a*, 28*b* may be carried out after the base portion 34 has been mounted on the slider portion 36. The lift cord may be routed out of the middle chamber 78 either via an end 52 or 54 of the slider portion 36, or via a slot 142 in top wall 44. The slider element 20, with the attached cord ladder 26 is then passed through the aperture 22 into the interior or head rail 12 (FIG. 5). The slider element 20 has at least one dimension which is greater than the maximum dimension of the aperture 22. Thus, when the slider element 20 has been received in the head rail 12, it is adjusted into an orientation in which it cannot pass through the aperture. In practice, the dimensions of the slider element, the operating bar (if used) and the head rail may be selected so that only one orientation of the slider element 20 is possible within the head rail. The slider element 20 is then arranged so that the base portion 34 is mounted at the aperture and preferably is seated in the aperture. If an operating bar 106 is used, the slider element 20 is appropriately engaged with the operating bar, such as by ensuring that the slider element 20 is disposed within the appropriate recess 116 of the operating bar 106. The process is repeated for second and subsequent slider elements and cord ladders, if present.

By the method as described above, steps which are potentially complex or require considerable dexterity, in particular threading of the cords 28*a*, 28*b*, are carried out outside the confines of the head rail 12 and are therefore much easier to do. Throughout the description and claims of this specification, the words "comprise" and "contain" and variations of the words, for example "comprising" and "comprises", means "including but not limited to", and is not intended to (and does not) exclude other moieties, additives, components, integers or steps.

Throughout the description and claims of this specification, the singular encompasses the plural unless the context otherwise requires. In particular, where the indefinite article is used, the specification is to be understood as contemplating plurality as well as singularity, unless the context requires otherwise.

Features, integers, characteristics, compounds, chemical moieties or groups described in conjunction with a particular aspect, embodiment or example of the invention are to be understood to be applicable to any other aspect, embodiment or example described herein unless incompatible therewith.

The invention claimed is:

1. A blind comprising: i) a plurality of slats; ii) a support structure including a wall defining an aperture therein; iii) a cord ladder by which the slats are supported, the cord ladder comprising a pair of longitudinal cords and a plurality of slat-supporting lateral threads extending between the longitudinal cords; iv) a slider element disposed in the support structure, the slider element comprising: c) a base portion mounted in fixed relation to the aperture; and d) a single slider portion attached to the base portion, having opposed first and second ends and being operably slidably moveable with respect to the base portion between a middle position and any of a range of positions in opposed first and second directions, wherein the longitudinal cords of the ladder pass through the aperture in the support structure; the base portion and the slider portion include surfaces which are configured to define a void between the base portion and the slider portion, said slider portion further including a top wall and first and second side walls depending from the top wall and arranged substantially parallel to the path of movement of the slider portion as well as a dividing wall configured to divide the void into first and second chambers, and wherein one of the longitudinal ladder cords is routed from a hole in the base portion through the first chamber and the other of the longitudinal ladder cords is routed from a hole in the base portion through the second chamber, said void being defined by inner surfaces of said top wall and side walls; the base portion defining first and second through holes which are spaced apart, and each longitudinal ladder cord is routed through a respective through hole and through said void; and an upper end portion of one of the ladder cords is secured to the slider portion proximate the first end thereof and an upper end portion of the other of the ladder cords is secured to the slider portion proximate the second end thereof; whereby movement of said slider portion in the first direction tilts the slats in one direction and movement of the slider portion in the second direction tilts the slats in an opposite direction.

2. A blind as claimed in claim 1 wherein the dividing wall is substantially linear and arranged parallel to the path of movement of the slider portion.

3. A blind as claimed in claim 1 wherein the dividing wall depends from the top wall of the slider portion.

4. A blind as claimed in claim 1 wherein the slider element comprises two dividing walls configured to divide the void into first, second and third chambers, and wherein one of the ladder cords is routed from a hole in the base portion through the first chamber and the other of the ladder cords is routed from a hole in the base portion through the second chamber.

5. A blind as claimed in claim 4 wherein each dividing wall is substantially linear and arranged parallel to the path of movement of the slider portion.

6. A blind as claimed in claim 4 wherein the dividing walls depend from the top wall of the slider portion.

7. A blind as claimed in claim 5 wherein the dividing walls depend from the top wall of the slider portion.

8. A blind as claimed in claim 1 wherein the base portion defines a plurality of spaced apart through holes and each through hole of the base portion is arranged in register with a respective chamber.

9. A blind as claimed in claim 4 wherein the base portion defines first second and third spaced apart through holes and each through hole of the base portion is arranged in register with a respective one of the first, second and third chambers.

10. A blind as claimed in claim 4 wherein the base portion defines a plurality of spaced apart through holes and each through hole of the base portion is arranged in register with a respective chamber.

11. A blind as claimed in claim 4 wherein the blind further comprises a lift or support cord configured to facilitate raising or lowering of the slats, and the base portion includes a third hole through which the lift cord is routed into the void.

12. A blind as claimed in claim 4 wherein the first chamber is defined between a first side wall of the slider portion and a first dividing wall, the second chamber is defined between a second side wall of the slider portion and a second dividing wall and the third, central, chamber is defined between the first and second dividing walls, one of the ladder cords is routed from its through hole in the base portion through the first chamber to the first end of the slider portion and the other of the ladder cords is routed from its through hole in the base portion through the second chamber to the second end of the slider portion.

13. A blind as claimed in claim 12 wherein the blind further comprises a lift or support cord configured to facilitate raising or lowering of the slats, and the base portion includes a third hole through which the lift cord is routed into the void and wherein the third hole of the base portion is in register with the third chamber and the lift or support cord is routed from the third hole through the third chamber.

14. A blind as claimed in claim 4 wherein the slider portion further comprises a first end wall section configured to close the first chamber at the second end of the slider portion, and a second end wall portion configured to close the second chamber at the first end of the slider portion.

15. A blind as claimed in claim 14 wherein the base portion includes projecting stop formations which cooperate with the respective end wall sections to limit movement of the slider portion with respect to the base portion.

16. A blind as claimed in 9 wherein the top wall of the slider portion defines a longitudinal slot in register with the third hole through which slot a lift or support cord for the slats may operatively pass.

17. A blind as claimed in claim 1 wherein ladder cord securing means are provided on a top surface of the top wall of the slider portion.

18. A blind as claimed in claim 12 wherein ladder cord securing means are provided on a top surface of the top wall of the slider portion.

19. A blind as claimed in 17 wherein the ladder cord securing means are formed integrally with the slider portion.

20. A blind as claimed in claim 19 wherein the ladder cord securing means include a securing member which is attached to the slider portion by means of a living hinge.

21. A blind as claimed in claim 1 wherein the base portion and the slider portion include cooperating formations by which the slider portion is attached to the base portion.

22. A blind as claimed in claim 21 wherein the formations of the base portion are sufficiently resiliently deformable to allow the base portion to "push fit" or "snap fit" on the slider portion after the ladder cords have been threaded through the holes in the base portion.

23. A blind as claimed in claim 21 wherein the formations of the slider portion are sufficiently resiliently deformable to allow the base portion to "push fit" or "snap fit" on the slider portion after the ladder cords have been threaded through the holes in the base portion.

24. A blind as claimed in claim 1 wherein the slider element and the aperture are respectively so sized that the slider element may be passed through the aperture when in an orientation other than its final orientation of use and may not be passed through the aperture when in said final orientation of use.

25. A blind as claimed in claim 1 including a plural number of cord ladders and the same plural number of slider elements, the cords of each cord ladder being attached to a respective slider element.

26. A blind as claimed in claim 25 further comprising at least one connector by which the slider portions of the slider elements are connected, whereby the slider portions of the slider elements are moveable in unison.

27. A blind as claimed in claim 1 wherein the base portion is seated in the aperture.

* * * * *